US012409394B1

(12) United States Patent
Hoffman et al.

(10) Patent No.: US 12,409,394 B1
(45) Date of Patent: Sep. 9, 2025

(54) INFANT ENTERTAINMENT DEVICE

(71) Applicant: Mattel, Inc., El Segundo, CA (US)

(72) Inventors: Lauren Rachael Hoffman, Buffalo, NY (US); Lawrence Martin Hopcia, Alden, NY (US); Patrick David Schaefer, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 19/041,221

(22) Filed: Jan. 30, 2025

(51) Int. Cl.
*A63H 33/00* (2006.01)

(52) U.S. Cl.
CPC ..... *A63H 33/006* (2013.01)

(58) Field of Classification Search
CPC ..... A63H 33/006
USPC ..... 446/227
See application file for complete search history.

(56) References Cited

U.S. PATENT DOCUMENTS

| | | | | |
|---|---|---|---|---|
| 2,723,856 | A | 11/1955 | Thomson | |
| 5,478,268 | A | 12/1995 | Au | |
| 6,203,395 | B1 | 3/2001 | McElhaney | |
| 6,592,425 | B2 * | 7/2003 | Bapst | A47D 15/00 5/655 |
| 6,629,727 | B2 * | 10/2003 | Asbach | B60N 2/2821 297/188.21 |
| 7,062,146 | B2 * | 6/2006 | Elias | A63H 33/006 297/135 |
| 7,963,896 | B2 | 6/2011 | Nanna et al. | |
| 8,795,023 | B2 | 8/2014 | Elson | |
| 2003/0171065 | A1 | 9/2003 | Greenberg | |
| 2004/0048547 | A1 * | 3/2004 | Gubitosi | A63H 33/006 446/173 |
| 2006/0052172 | A1 * | 3/2006 | Stephen | A63H 33/006 472/135 |
| 2007/0224909 | A1 * | 9/2007 | Schoenfelder | A63H 33/006 446/227 |
| 2011/0237411 | A1 | 9/2011 | Nanna et al. | |
| 2011/0269368 | A1 | 11/2011 | Gudipati | |

FOREIGN PATENT DOCUMENTS

| | | | |
|---|---|---|---|
| FR | 3120315 | A1 | 9/2022 |

* cited by examiner

*Primary Examiner* — Joseph B Baldori
(74) *Attorney, Agent, or Firm* — Edell, Shapiro & Finnan, LLC

(57) ABSTRACT

An aspect of the infant entertainment device relates to an entertainment component that is moved by an input from an infant. In one embodiment, the entertainment component moves in response to a kicking input from an infant in a supine position. The infant entertainment device includes an input mechanism that is positioned so that the infant can move the input mechanism by kicking it. The infant entertainment device includes a drive mechanism that converts movement of the input mechanism into motion of the entertainment component. In one implementation, the entertainment component is a mobile that moves when the infant kicks the input mechanism.

17 Claims, 16 Drawing Sheets

INFANT ENTERTAINMENT DEVICE

TECHNICAL FIELD

The present disclosure relates to an infant entertainment device, and in particular, to an infant entertainment device with an entertainment portion that can be moved by an infant.

BACKGROUND OF THE INVENTION

Some conventional infant structures have mobiles that are static and not movable. Sometimes, such mobiles do not provide entertainment for an infant proximate to the conventional infant structures.

Therefore, there is a need for an infant entertainment device that has a portion that is engageable by an infant in a supine position. There is also a need for an infant entertainment device that has a portion that moves in response to infant inputs.

SUMMARY OF THE INVENTION

The present disclosure is directed to an infant entertainment device, comprising a support member for an infant, a housing positioned above the support member, an entertainment component rotatably coupled to the housing, the entertainment component being movable relative to the housing between a first position and second position, an input mechanism movably supported by the housing, the input mechanism being pivotally mounted and movable between a third position and a fourth position, the input mechanism being located above the support member so the input mechanism can be kicked by an infant lying on the support member, and a drive mechanism connected to the entertainment component and to the input mechanism, wherein movement of the input mechanism from its third position to its fourth position causes the drive mechanism to move the entertainment component from its first position to its second position.

In one embodiment, the drive mechanism includes a biasing member that engages the input mechanism, and the biasing member applies a force to the input mechanism so that the input mechanism moves from its fourth position to its third position.

In another embodiment, the biasing member is a first biasing member, the drive mechanism includes a second biasing member, and each of the first biasing member and the second biasing member engaging the input mechanism.

In an alternative embodiment, the housing includes an axle, the input mechanism is rotatably mounted on the axle, the input mechanism includes an engagement portion and a pair of mounting portions coupled to the engagement portion, each of the first biasing member and the second biasing member contacting one of the mounting portions, and each of the mounting portions being rotatably mounted on the axle.

In another embodiment, the entertainment component includes an arm and a moving component coupled to the arm at a pivot axis, the moving component being configurated to rotate about the pivot axis as the arm moves back and forth, the moving component including a body with a center of gravity that is offset from the pivot axis, and the movement of the body about the pivot axis is randomized by the center of gravity being offset from the pivot axis.

In one embodiment, the drive mechanism includes a first axle having a first gear mounted thereon, the first axle being connected to the entertainment component so that movement of the first gear results in rotation of the first axle and rotation of the entertainment component, and a second axle having a second gear mounted thereon, the second gear being engaged with the first gear so that rotation of the second gear drives the first gear.

In another embodiment, the drive mechanism includes a third axle having a clutch member rotatably mounted thereon, the clutch member being engaged with the second gear, the input mechanism is rotatably mounted on the third axle, and movement of the input mechanism drives the clutch member to rotate about the third axle which causes the second gear to rotate.

In yet another embodiment, the input mechanism includes a first keying member, the clutch member includes a second keying member, the second keying member being engaged with the first keying member so that movement of the input mechanism causes the clutch member to move.

In an alternative embodiment, the second gear includes a body having a first side and a second side opposite the first side, the body includes an arcuate toothed portion on the first side and a tab extending from the second side, the tab being engaged by the clutch member, and movement of the clutch member drives the tab of the body, thereby causing the second gear to rotate.

In one embodiment, the clutch member includes a clutch body having a mounting portion including the second keying member, the mounting portion being mounted on the third axle, and a drive portion coupled to the mounting portion, and a biasing mechanism, wherein the biasing mechanism is moved by the drive portion of the clutch body, the biasing mechanism engages the tab of the second gear, and movement of the biasing mechanism drives the tab and rotates the second gear.

In another aspect of the present invention, an infant entertainment device comprises a support member for an infant, a housing positioned above the support member, an entertainment component coupled to the housing and movable relative to the housing between a first position and second position, an input mechanism coupled to the housing and movable between a third position and a fourth position, the input mechanism being located above the support member so the input mechanism can be kicked by an infant lying on the support member, and a drive mechanism connected to the entertainment component and to the input mechanism, the drive mechanism includes a biasing member, wherein movement of the input mechanism from its third position to its fourth position causes the entertainment component to move from its first position to its second position, and the biasing member biases the input mechanism from its fourth position to its third position, thereby causing the entertainment component to return from its second position to its first position.

In one embodiment, the input mechanism is pivotally mounted to the housing and is located below the housing.

In another embodiment, the entertainment component is rotatably mounted to the housing and is located above the housing.

In yet another embodiment, the biasing member is a first biasing member, the drive mechanism includes a second biasing member, and each of the first biasing member and the second biasing member engages the input mechanism to bias the input mechanism from its fourth position to its third position relative to the housing.

In another embodiment, the drive mechanism includes a first axle having a first gear mounted thereon, the first axle being connected to the entertainment component so that movement of the first gear results in rotation of the first axle and rotation of the entertainment component, a second axle having a second gear mounted thereon, the second gear being engaged with the first gear so that rotation of the second gear drives the first gear, and a third axle having a clutch member rotatably mounted thereon, and the clutch member is engaged with the second gear.

In an alternative embodiment, the input mechanism is rotatably mounted on the third axle, and movement of the input mechanism drives the clutch member to rotate about the third axle which causes the second gear to rotate, the input mechanism includes a first keying member, the clutch member includes a second keying member, the second keying member being engaged with the first keying member so that movement of the input mechanism causes the clutch member to move.

In an alternative embodiment, the entertainment component includes an arm and a moving component coupled to the arm at a pivot axis, the moving component being configurated to rotate about the pivot axis as the arm moves back and forth, the moving component including a body with a center of gravity that is offset from the pivot axis, and the movement of the body about the pivot axis is randomized by the center of gravity being offset from the pivot axis.

In another aspect of the present invention, an infant entertainment device comprising a support member for an infant, a housing positioned above the support member, an entertainment component coupled to the housing and movable relative to the housing about a first axis between a first position and second position, an input mechanism coupled to the housing and movable about a second axis between a third position and a fourth position, the input mechanism being located above the support member so the input mechanism can be kicked by an infant lying on the support member, and a drive mechanism connected to the entertainment component and to the input mechanism, the drive mechanism includes a biasing member, wherein movement of the input mechanism about the second axis from its third position to its fourth position causes the entertainment component to move about the first axis from its first position to its second position, and the biasing member biases the input mechanism from its fourth position to its third position, thereby causing the entertainment component to return from its second position to its first position, the second axis being perpendicular to the first axis.

In an alternative embodiment, the input mechanism is pivotally mounted to the housing and is located below the housing, and the entertainment component is rotatably mounted to the housing and is located above the housing.

In another embodiment, the entertainment component includes an arm and a moving component coupled to the arm at a pivot axis, the moving component being configurated to rotate about the pivot axis as the arm moves back and forth, the moving component including a body with a center of gravity that is offset from the pivot axis, and the movement of the body about the pivot axis is randomized by the center of gravity being offset from the pivot axis.

Other systems, apparatuses, methods, features, and advantages will be, or will become, apparent to one with skill in the art upon examination of the following figures and detailed description. All such additional systems, apparatuses, methods, features, and advantages are included within this description, are within the scope of the claimed subject matter.

BRIEF DESCRIPTION OF THE DRAWINGS

The infant entertainment device disclosed herein may be better understood with reference to the following drawings and description. It should be understood that some elements in the figures may not necessarily be to scale and that emphasis has been placed upon illustrating the principles disclosed herein. In the figures, like-referenced numerals designate corresponding parts throughout the different views.

DETAILED DESCRIPTION OF THE INVENTION

An aspect of the infant entertainment device relates to an entertainment component that is moved by an input from an infant. In one embodiment, the entertainment component moves in response to a kicking input from an infant in a supine position. The infant entertainment device includes an input mechanism that is positioned so that the infant can move the input mechanism by kicking it.

The infant entertainment device includes a drive mechanism that converts movement of the input mechanism into motion of the entertainment component. In one implementation, the entertainment component is a mobile that moves when the infant kicks the input mechanism.

Figure 1:
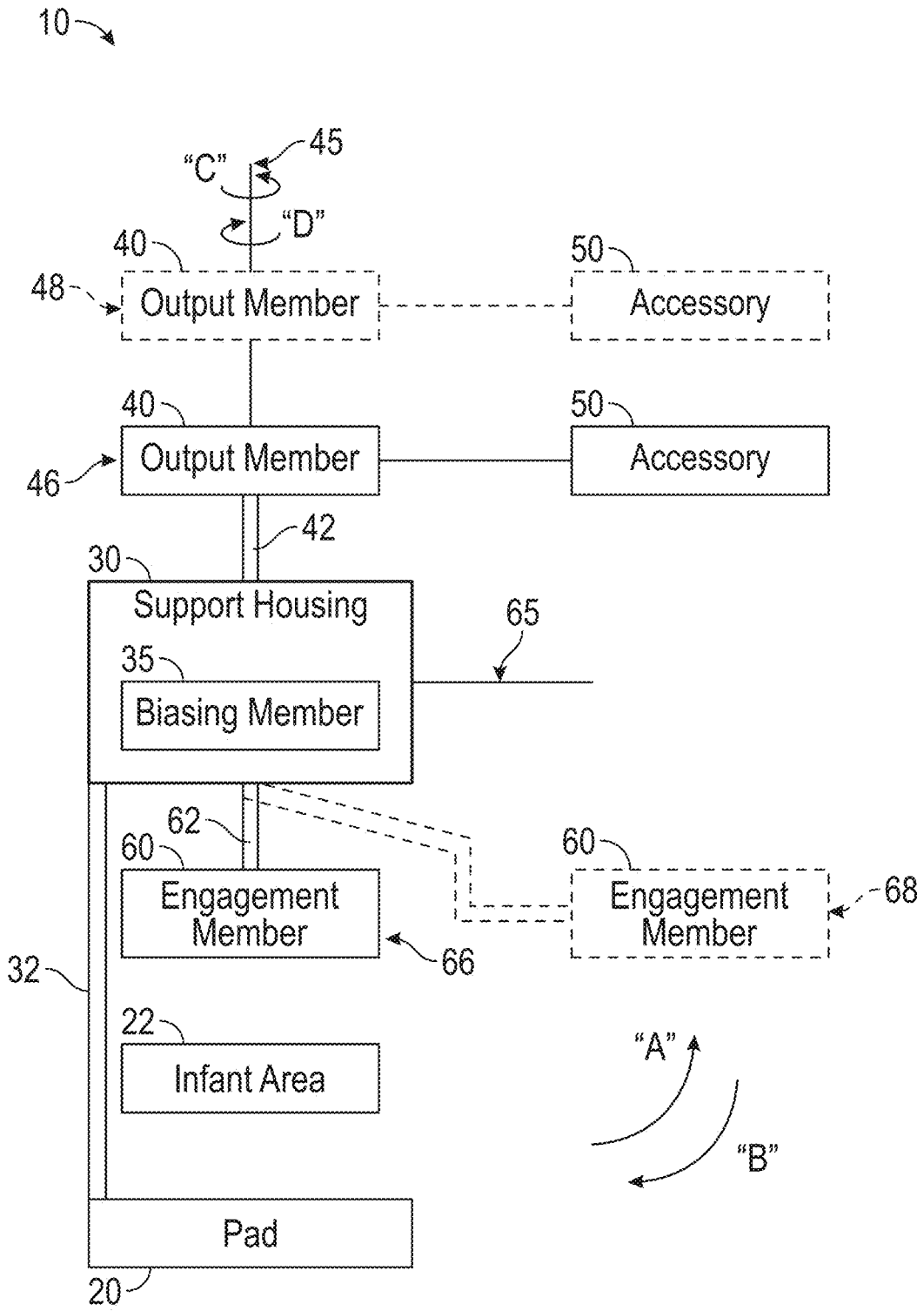
FIG. 1 is a schematic diagram of an embodiment of an infant entertainment device according to the present invention.

A schematic diagram of an embodiment of an infant entertainment device according to the present invention is illustrated in FIG. 1. In this embodiment, the infant entertainment device 10 includes a pad 20 on which an infant can be positioned in an infant area 22. In one use of the infant entertainment device 10, an infant can be placed in a supine position on the pad 20. The infant entertainment device 10 includes a housing or support housing 30 that is held in a position relative to the pad 20 by a support 32. In one implementation, the support 32 is a support arm. In another implementation, there may be two support arms that hold the support housing 30. The support housing 30 is positioned above the pad 20.

Coupled to the support housing 30 is an engagement member 60 that can be moved relative to the support housing 30 between different positions. The engagement member 60 is coupled to the support housing 30 by one or more mounting arms 62. In this embodiment, the engagement member 60 is mounted for movement relative to support housing 30 about axis 65.

The engagement member 60 that can be engaged by an infant located in the infant area 22. In particular, an infant in a supine position in the infant area 22 on the pad 20 can engage the engagement member 60 using the infant's feet. By kicking the engagement member 60, the infant causes the engagement member 60 to move along the direction of arrow "A" about axis 65 from position 66 to position 68 relative to the support housing 30. The support housing 30 includes a biasing member 35 that is engaged with the engagement member 60 as well. The biasing member 35 is positioned so that it applies a force on the engagement member 60 so that the engagement member 60 moves along the direction of arrow "B" about axis 65 from position 68 to position 66. Thus, when an infant is no longer applying a force on the engagement member 60, the biasing member 35 moves the engagement member 60 back to its initial position 66. In different embodiments, the biasing member 35 can be a mechanism that can apply a force, such as a compression spring.

Infant entertainment device 10 includes an output member 40 that is movably supported by the housing 30. The output member 40 can be referred to alternatively as an entertainment component. The output member 40 is positioned so that it is viewable by an infant located in the infant area 22. A mounting arm 42 supports the output member 40 relative to the housing 30. In one embodiment, an accessory 50 is coupled to the output member 40. The accessory 50 can be fixedly or movably coupled to the output member 40. In the implementation in which the accessory 50 is movably coupled to the output member 40, movement of the output member 40 results in additional movement of the accessory 50 relative to the output member 40, thereby increasing the visual stimulation for an infant on the pad 20.

Infant entertainment device 10 includes a drive mechanism that is connected to the engagement member 60 and to the output member 40. Different embodiments of drive mechanisms are described in detail below. Movement of the engagement member 60 causes the drive mechanism to move the output member 40. In this embodiment, the output member 40 can be moved along the direction of arrow "C" about axis 45 from position 46 to position 48 when the engagement member 60 is moved from position 66 to position 68. When the engagement member 60 moves from position 68 to position 66 due to biasing member 35, the output member 40 moves along the direction of arrow "D" about axis 45 from position 48 to position 46.

Figure 2:
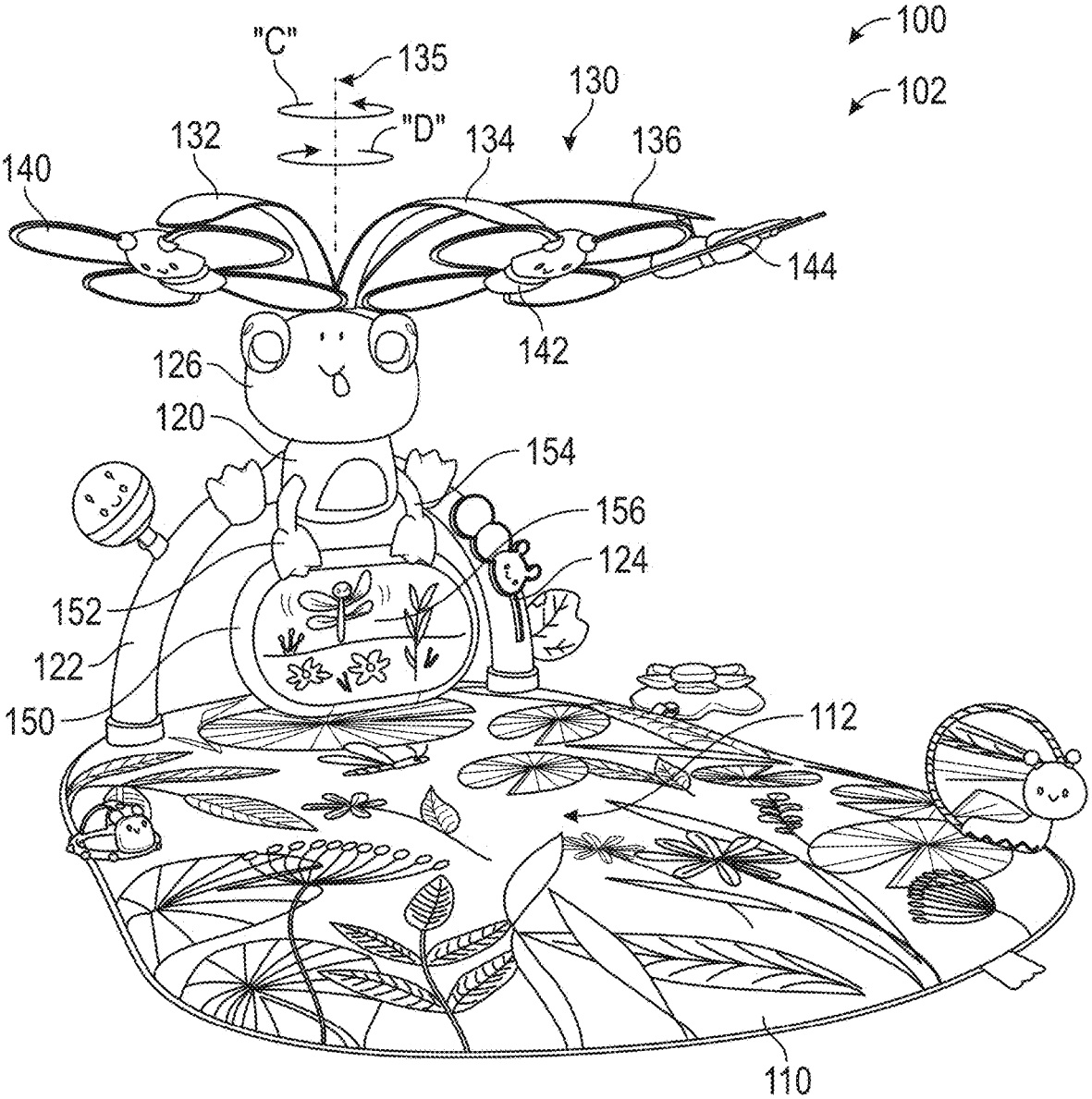
FIG. 2 is a perspective view of an embodiment of an infant entertainment device in a first configuration according to the present invention.

Turning to FIG. 2, a perspective view of an embodiment of an infant entertainment device in a first configuration is illustrated. In this embodiment, the infant entertainment device 100 is shown in a first configuration 102. Infant entertainment device 100 includes a support member or pad 110 that defines a support area or infant area 112 in which an infant can be placed. An infant can be placed in area 112 on pad 110 in a supine position or orientation.

Infant entertainment device 100 also includes a housing 120 that is connected to support arms 122 and 124 that are coupled to the pad 110. The lower ends of the arms 122 and 124 can engage openings in the pad 110, which holds the lower ends of the arms 122 and 124 in a fixed position relative to the pad 110. Also coupled to housing 120 are a pair of arms 152 and 154 that support an engagement member 150. The arms 152 and 154 are pivotally mounted relative to the housing 120. When an infant (not shown) contacts an engagement surface 156 of the engagement member 150, such as by kicking surface 156, the engagement member 150 and arms 152 and 154 pivot relative to the housing 120.

The housing 120 includes an upper portion or upper housing 126 to which an entertainment mechanism or entertainment component 130 is movably coupled. The entertainment component 130 is an overhead mobile. In this embodiment, entertainment component 130 includes several arms 132, 134, and 136 that have accessories 140, 142, and 144 coupled thereto. The entertainment component 130 can be rotated about axis 135 along the direction of arrow "C" and also rotated about axis 135 along the direction of arrow "D". When the engagement member 150 is moved by an infant, a drive mechanism connected to the engagement member 150 causes the entertainment component 130 to rotate about axis 135.

Figure 3:
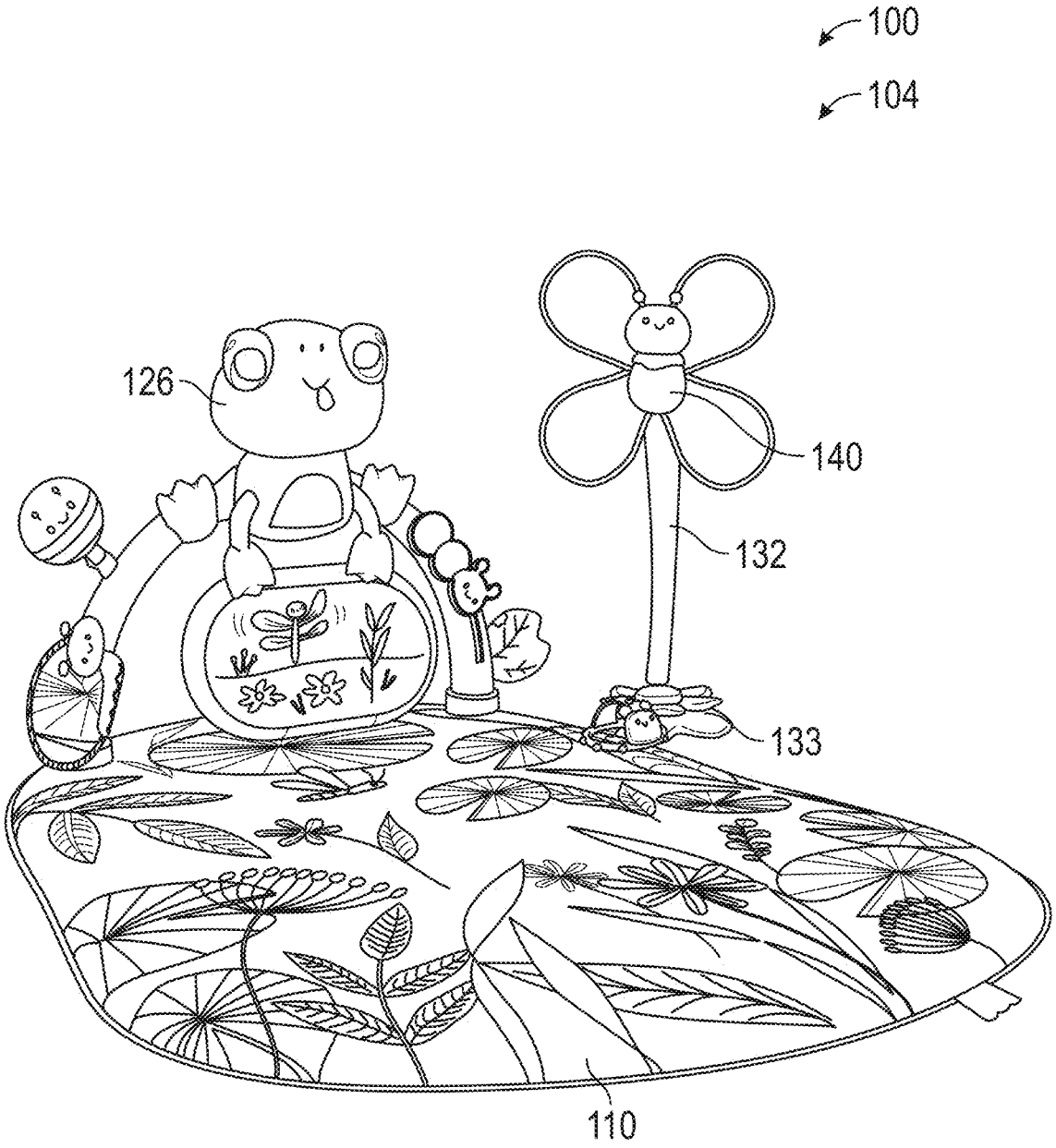
FIG. 3 is a perspective view of the infant entertainment device illustrated in FIG. 2 in a second configuration according to the present invention.
Figure 4:
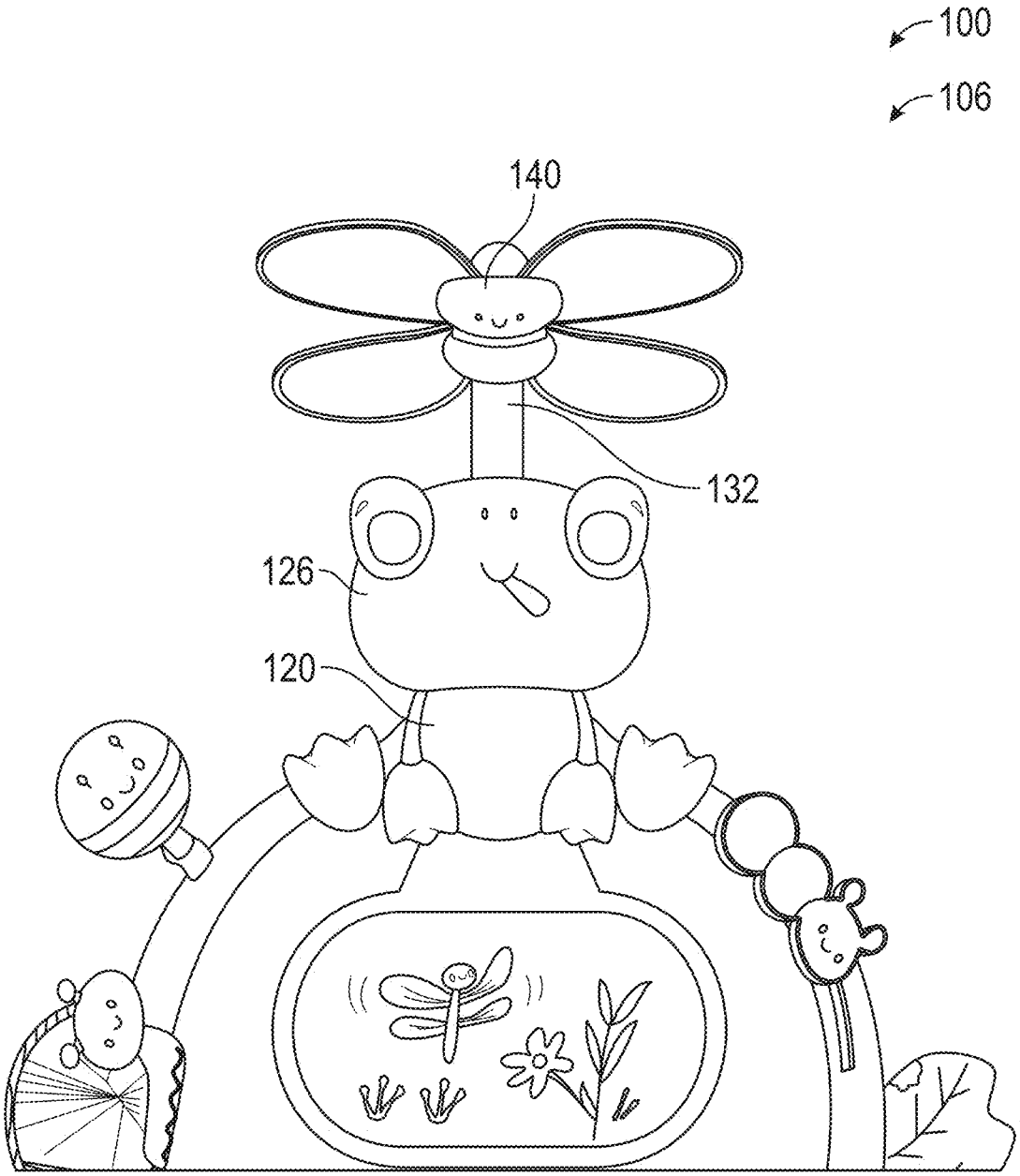
FIG. 4 is a front view of a portion of the infant entertainment device illustrated in FIG. 2 in a third configuration according to the present invention.

Turning to FIGS. 3 and 4, infant entertainment device 100 is illustrated in alternative configurations 104 and 106, respectively. In configuration 104 (see FIG. 3), arm 132 and accessory 140 have been decoupled from upper housing 126 and mounted into a base 133 located on one side of the pad 110. In configuration 106 (see FIG. 4), arm 132 and accessory 140 are the only items mounted to the upper housing 126.

Figure 5:
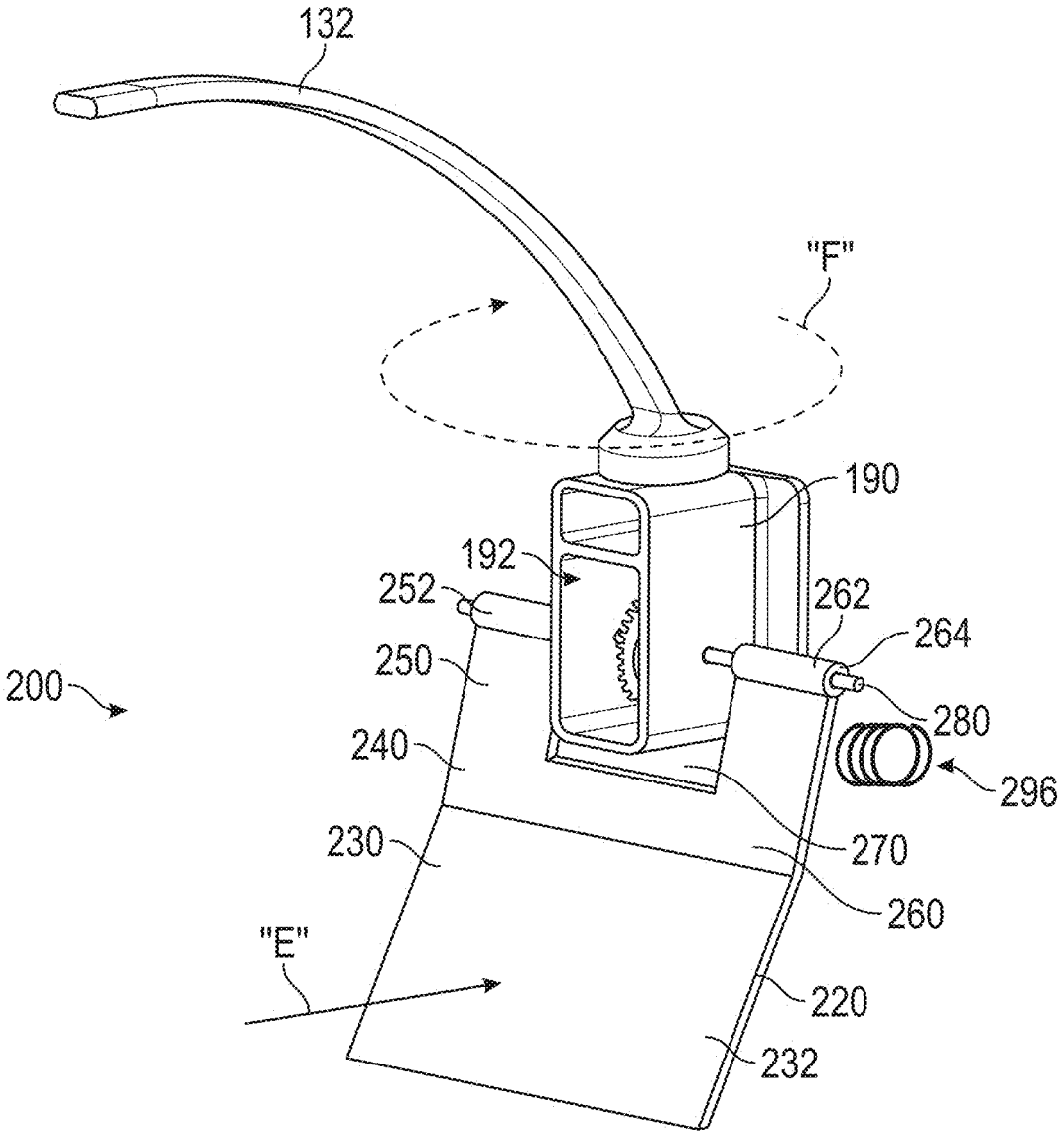
FIG. 5 is a perspective view of some components of another embodiment of infant entertainment device according to the present invention.
Figure 6:
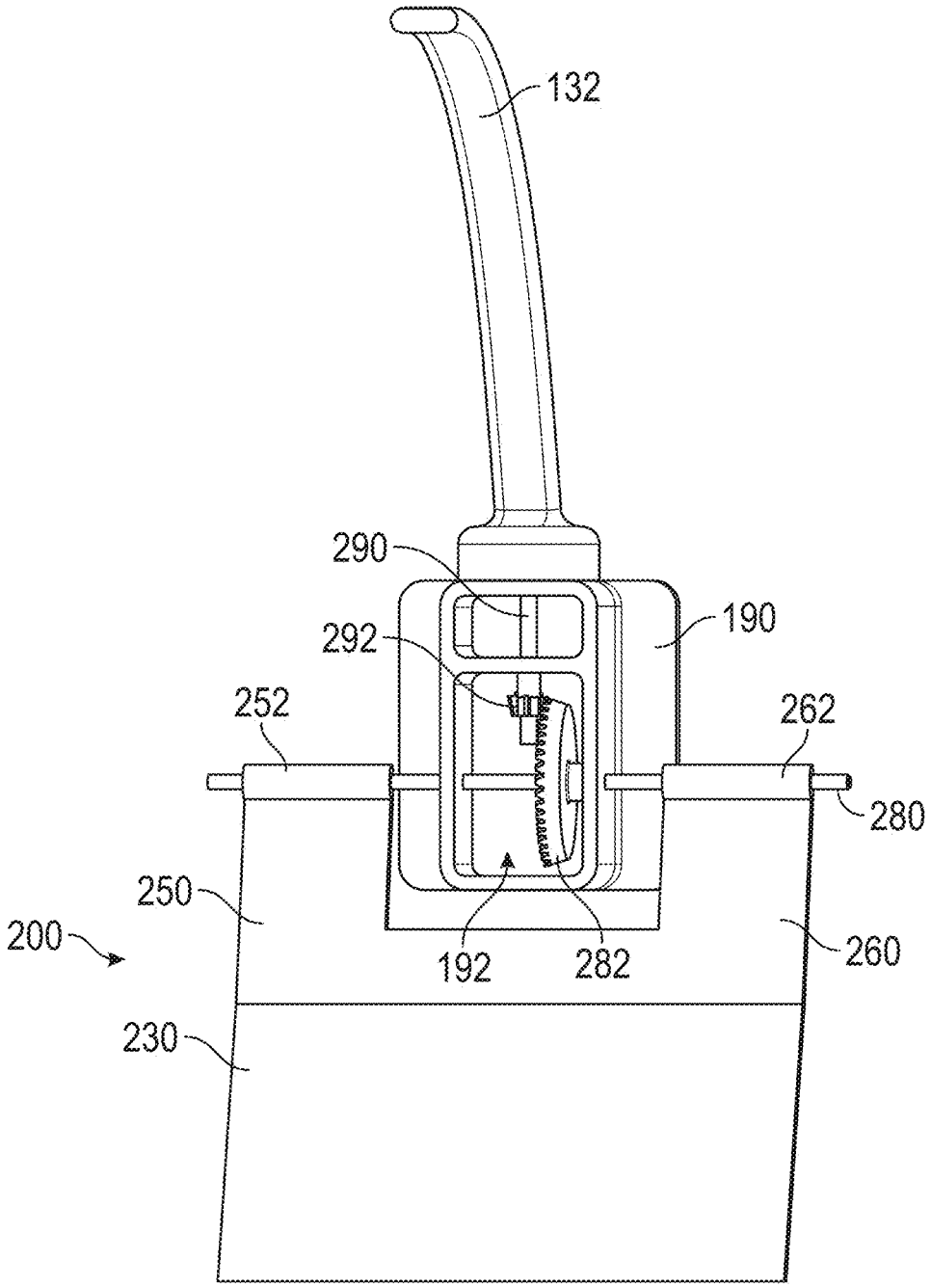
FIG. 6 is a front view of the components illustrated in FIG. 5.

Turning to FIGS. 5 and 6, perspective and front views of some components of another embodiment of infant entertainment device according to the present invention are illustrated. In this embodiment, the support housing of the infant entertainment device includes a gearbox housing 190 that defines a cavity 192. Coupled to the gearbox housing 190 is an arm 132 that rotates along the direction of arrow "F" about an axis. The arm 132 can also be rotated in the opposite direction of arrow "F" as well.

Also, movably coupled to the gearbox housing 190 is an input mechanism 200. In this embodiment, the input mechanism 200 includes an input member 220 that can be engaged by an infant, such as by the infant kicking the input member 220. The input member 220 has an engagement member or engagement portion 230 that has an engagement surface 232. Extending from the engagement portion 230 is a mounting portion 240 that is rotatably coupled to the gearbox housing 190. In this embodiment, the mounting portion includes a pair of mounting arms 250 and 260 that define a gap or space 270 therebetween. Gearbox housing 190 extends into the gap 270 and includes an axle 280 extending therefrom.

Mounting arm 250 includes a sleeve 252 with a passageway extending therethrough. Similarly, mounting arm 260 includes a sleeve 262 with a passageway 264 extending therethrough. The axle 280 extends through passageways in the sleeves 252 and 262. When the axle 280 rotates, the sleeves 252 and 262 and the mounting arms 250 and 260 rotate with the axle 280. Thus, when an infant applies a force long the direction of arrow "E" on the engagement surface 232, the input member 220 and the axle 280 rotate therewith.

Referring to FIG. 6, gear 282 is mounted on axle 280. As axle 280 rotates, gear 282 also rotates. The drive mechanism include an axle 290 that has a gear 292 mounted thereon. The teeth of gear 292 are engaged with the teeth of gear 282. As a result, when gear 282 rotates, gear 292 and axle 290 also rotate. While in this example embodiment, gear 282 is a crown gear and gear 292 is a bevel gear, in other embodiments, the types of gears and their relative sizes can vary.

The drive mechanism also includes one or more biasing members that apply a force onto a rear surface of the input member 220 to move it in a direction opposite to arrow "E" about axle 280. While there is a biasing member on the back side of each of mounting arms 250 and 260, in FIG. 5 only biasing member 296 is shown. The engagement portion 230 is spring biased to return to its initial or default position by the biasing member 296.

Turning to FIGS. 7-12, various components of an alternative embodiment of an infant entertainment device according to the present invention are illustrated. Initially referring to FIGS. 7 and 8, only part of the support housing, support arms, the drive mechanism, and the input mechanism are illustrated. The outer or front portion of the support housing has been removed to reveal the internal components. Infant entertainment device 300 includes a support housing 305 and an input mechanism 310 movably coupled to the support housing 305. The input mechanism 310 includes an engagement portion 320 with an engagement surface 322. The engagement surface 322 can be engaged by an infant, such as by kicking.

The input mechanism 310 is coupled to two arms 330 and 340 that are rotatably mounted relative to the support housing 305. Arms 330 and 340 can be referred to alternatively as mounting portions. Arm 330 includes a sleeve 332 and a paddle portion 336 extending upwardly therefrom. Similarly, arm 340 includes a sleeve 342 and a paddle portion 346 extending upwardly therefrom. Sleeve 332 is located in a notch formed in the mount or flange 430 located in the support housing. Similarly, sleeve 342 is located in a notch formed in the mount or flange 440 located in the support housing.

Figure 7:
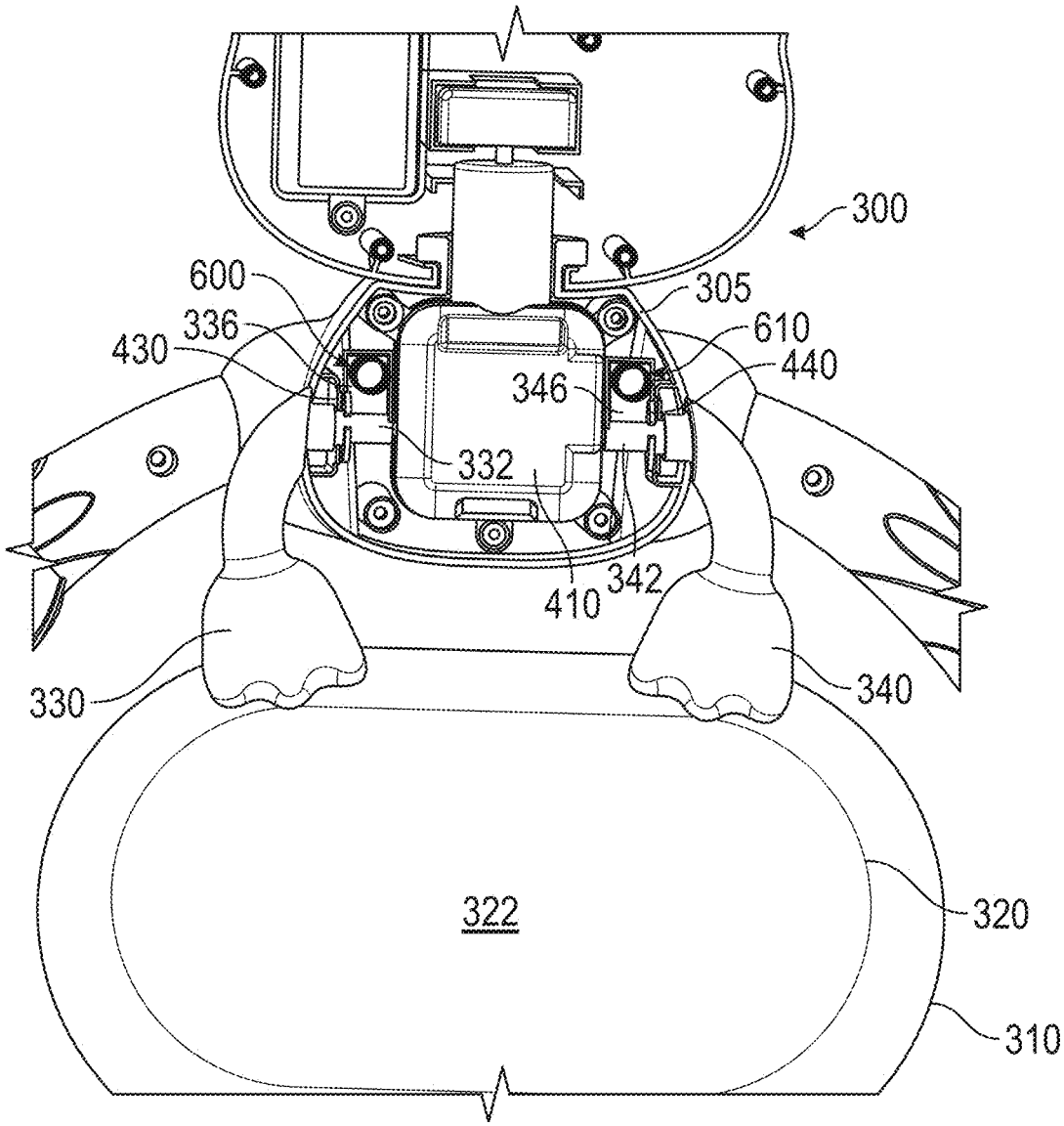
FIG. 7 is a front view of some components of another embodiment of infant entertainment device according to the present invention.
Figure 8:
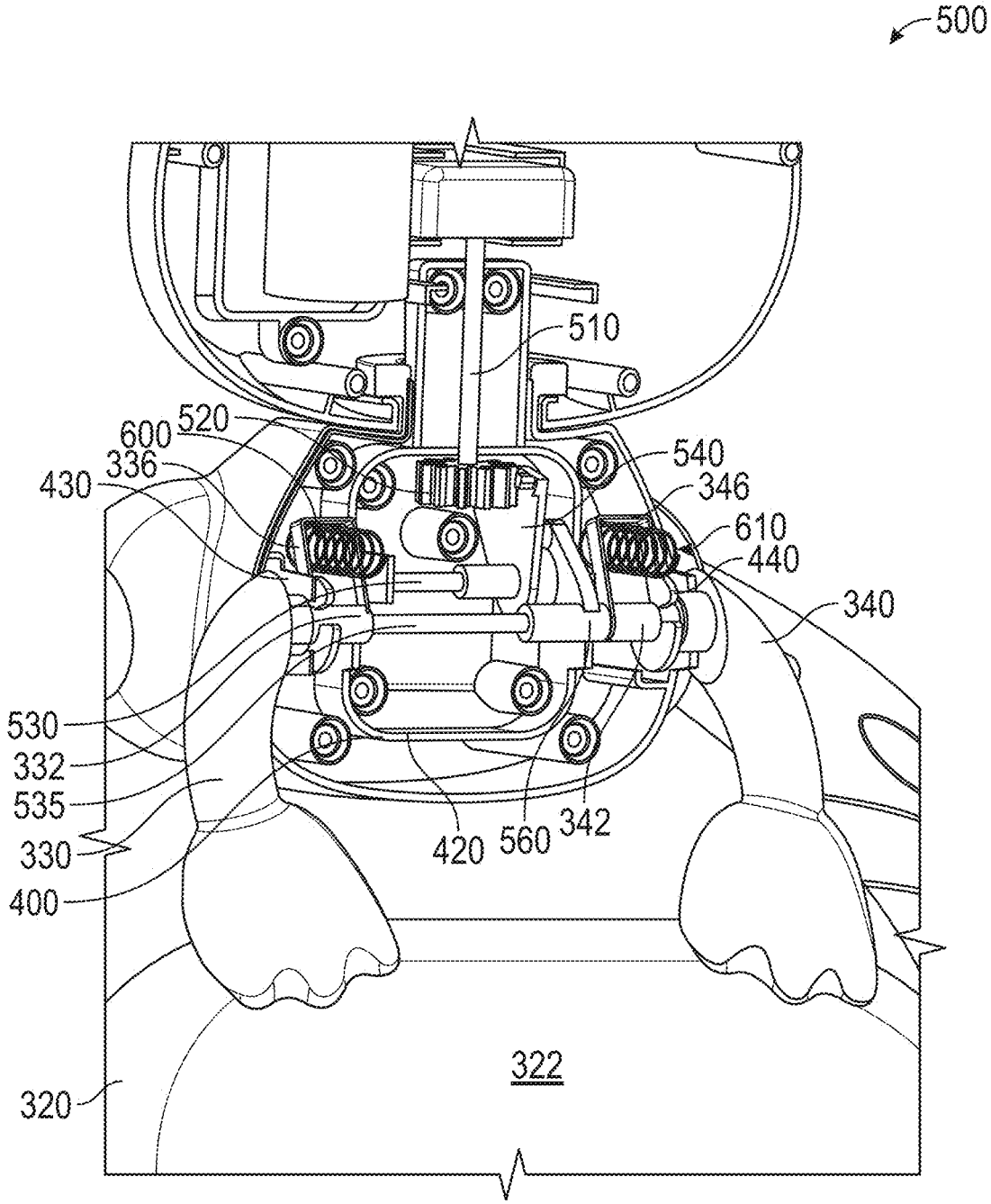
FIG. 8 is a front perspective view of the components illustrated in FIG. 7 with a portion of the housing removed.

In this embodiment, there are two biasing members 600 and 610 that engage the front surfaces of paddle portions 336 and 346 to bias the paddle portions 336 and 346 toward the rear of the support housing. In FIG. 7, the front cover or front housing portion 410 of gearbox housing 400 is illustrated covering the gears of the drive mechanism. Turning to FIG. 8, the front cover 410 has been removed, thereby revealing the various components of the drive mechanism 500 and the rear cover or rear housing portion 420. The biasing members 600 and 610 and their relative positions to engage the paddle portions 336 and 346, respectively, are shown in FIG. 8. Also visible are the mounts or flanges 430 and 440, and also the sleeves 332 and 342 of arms 330 and 340.

In the gearbox housing 400, axle 510 extends vertically and includes a gear 520 mounted thereon. In addition, axle 530 extends horizontally and includes a gear 540 mounted thereon. The drive mechanism 500 also includes an additional axle 535 that has a clutch 560 mounted thereon. As described in greater detail below, the clutch 560 is engaged with gear 540 and drives gear 540 to rotate about the axis defined by the longitudinal axis of axle 530.

When an infant engages surface 322 of engagement portion 320, movement of the engagement portion 320 moves arms 330 and 340 about the axis defined by the longitudinal axis of axle 535. The sleeve 342 is engaged with the clutch 560 so that when sleeve 342 rotates, the clutch 560 rotates as well. As clutch 560 is engaged with gear 540, the rotation of clutch 560 causes gear 540 and axle 530 to rotate. When gear 540 rotates, it causes gear 520 and axle 510 to rotate as well. Axle 510 is connected via to another gear that drives the entertainment member of the infant entertainment device.

Figure 9:
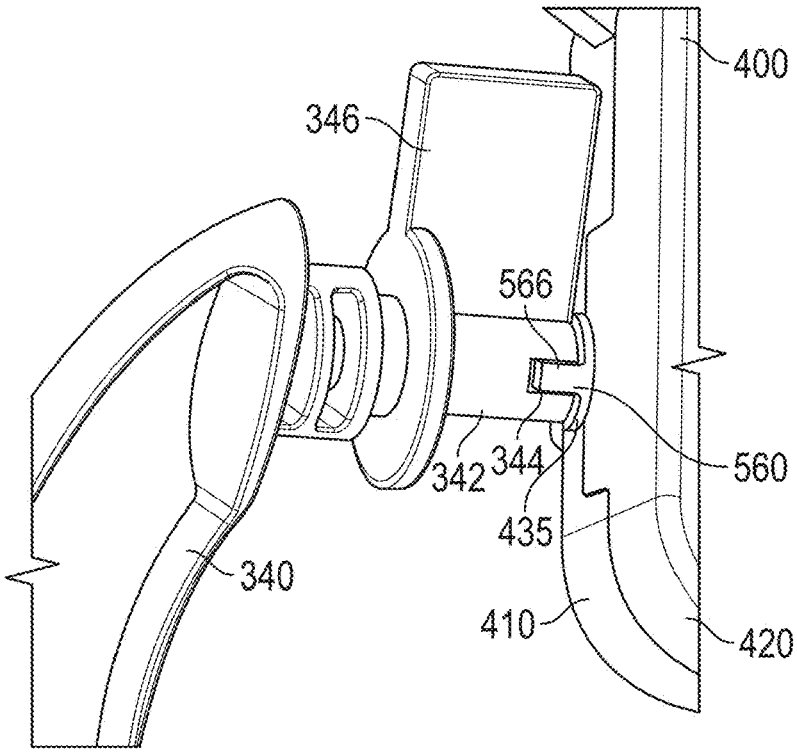
FIG. 9 is a perspective view of a portion of the components illustrated in FIG. 7.

Turning to FIG. 9, a rear perspective view of a portion of some of the components illustrated in FIG. 7 is shown. In this view, the front housing portion 410 and the rear housing portion 420 that form the gearbox housing 400 are shown. The front housing portion 410 and rear housing portion 420 define an opening 435 therebetween. The clutch 560 extends through the opening 435 and includes a keying member 566, which in this embodiment is a tab.

As shown, the sleeve 342 of the arm 340 includes keying member 344, which in this embodiment is a notch. Keying member 344 receives keying member 566, which results in the rotation of sleeve 342 causing clutch 560 to rotate as well. Extending from sleeve 342 is the paddle portion 346.

Figure 10:
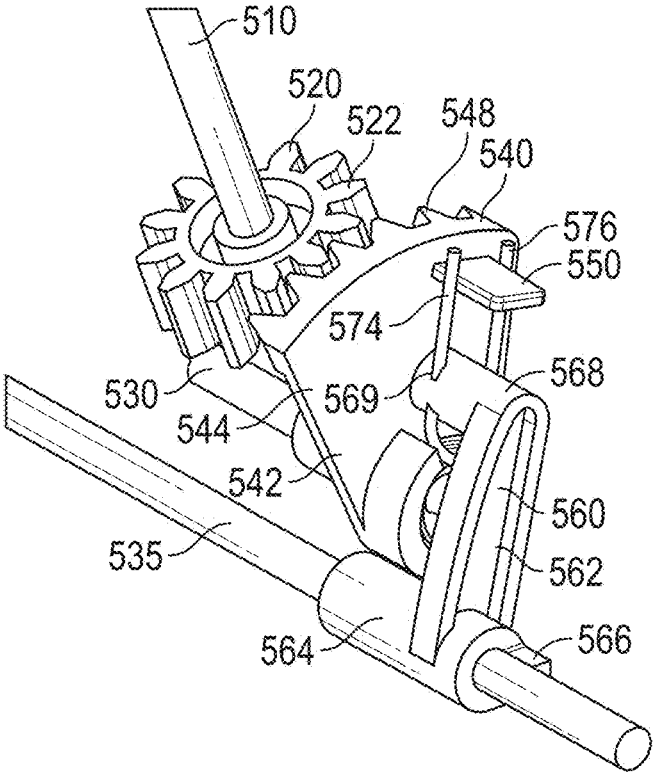
FIG. 10 is a perspective view of some components of the drive mechanism of the infant entertainment device illustrated in FIG. 7.
Figure 11:
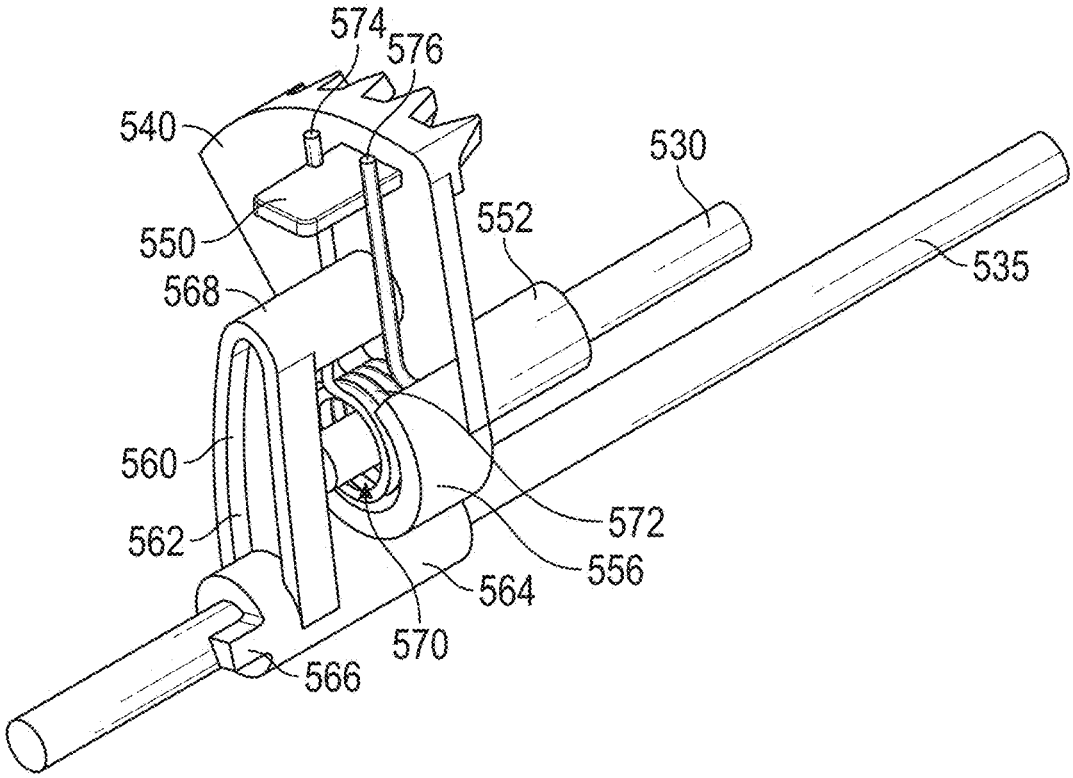
FIG. 11 is another perspective view of some components of the drive mechanism of the infant entertainment device illustrated in FIG. 7.
Figure 12:
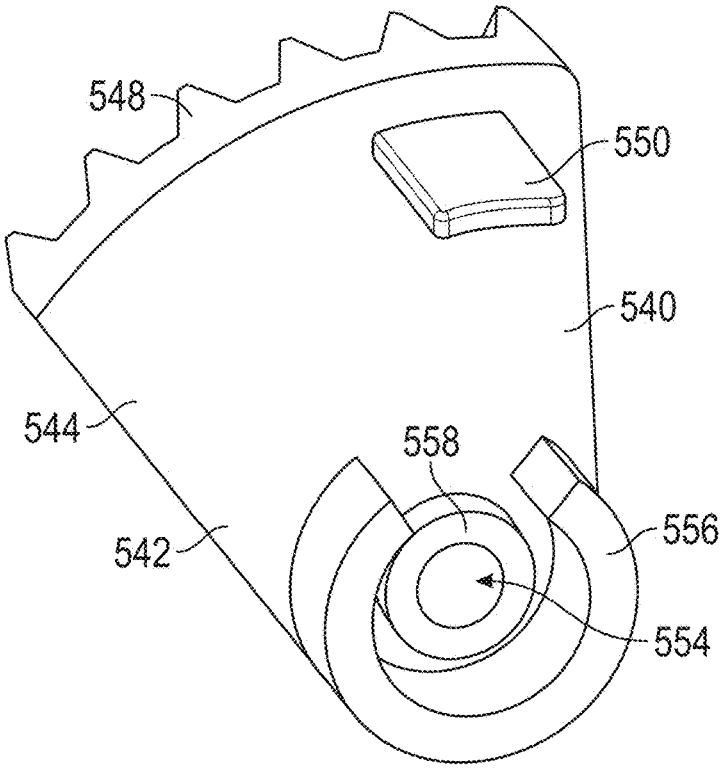
FIG. 12 is a perspective view of one of the gears of the drive mechanism illustrated in FIG. 10.
Figure 13:
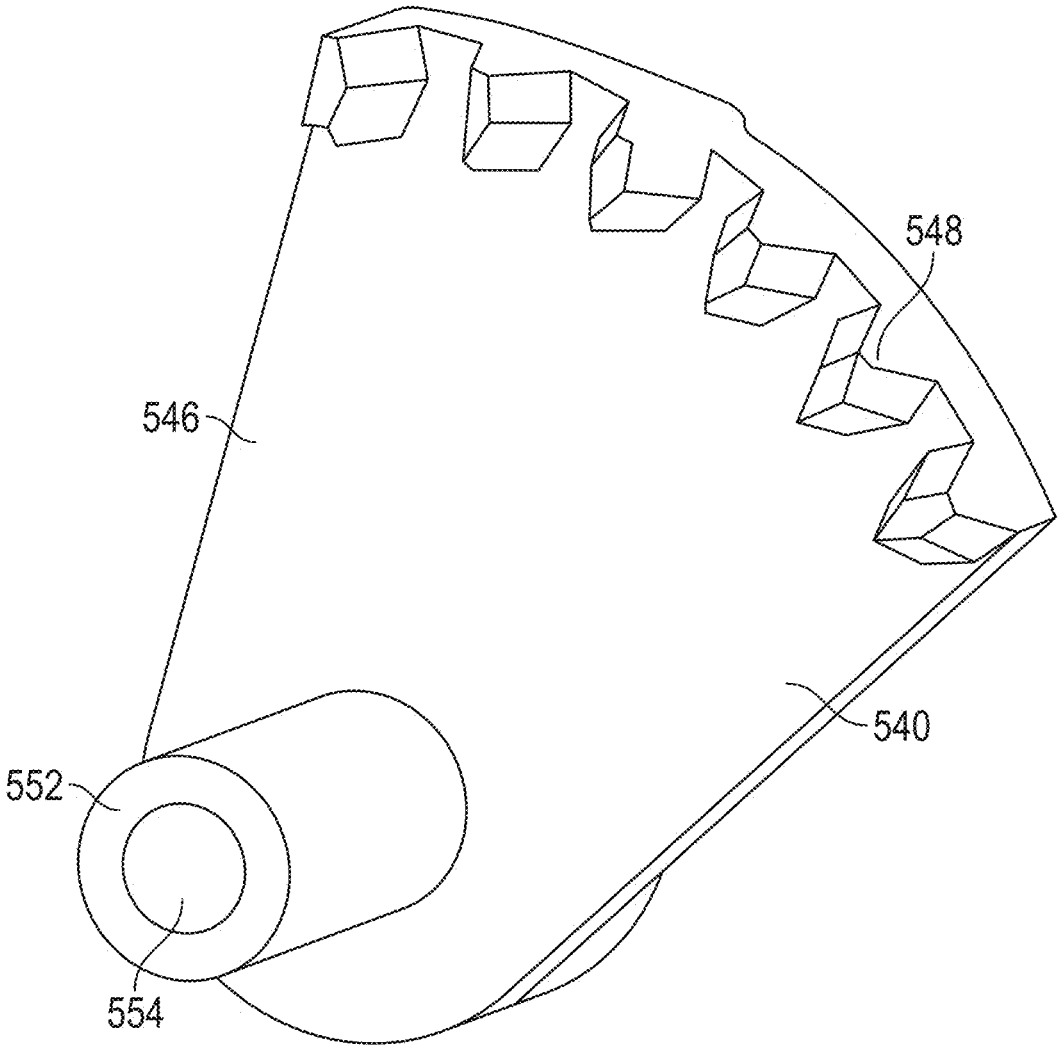
FIG. 13 is another perspective view of the gear illustrated in FIG. 12.

FIGS. 10 and 11 are perspective views of some components of the drive mechanism 500 of the infant entertainment device, and FIGS. 12 and 13 are perspective views of gear 540. As shown, gear 520 with teeth 522 is mounted to axle 510 and rotates therewith. Gear 540 is mounted to axle 530 and rotates therewith. Gear 540 includes a body 542 that has a first side 544 and an opposite second side 546 (see FIG. 13). Extending from side 544 is a tab 550. Extending from side 546 are teeth 548, which are engaged with teeth 522 of gear 520. In this embodiment, the teeth 548 are formed in an accurate shape. Also extending from side 546 is a sleeve 552 that has a passageway 554 through which axle 530 extends.

Clutch 560 includes a clutch body 562 with a mounting portion 564 that is mounted on axle 535. The keying member 566 extends in a direction away from the mounting portion 564. Extending from the mounting portion 564 is a drive portion 568 that is engaged with a biasing mechanism or biasing member 570.

In this embodiment, the biasing mechanism 570 is a torsion spring that has a coiled portion 572 that has two extended ends 574 and 576. End 574 extends through hole 569 formed in drive portion 568. The gear 540 also includes a collar 556 (see FIG. 11) that defines a receptacle for the biasing mechanism 570. Located inside collar 556 is a shorter collar 558 that extends into the central opening of the coiled portion 572 of biasing mechanism 570.

Figure 14:
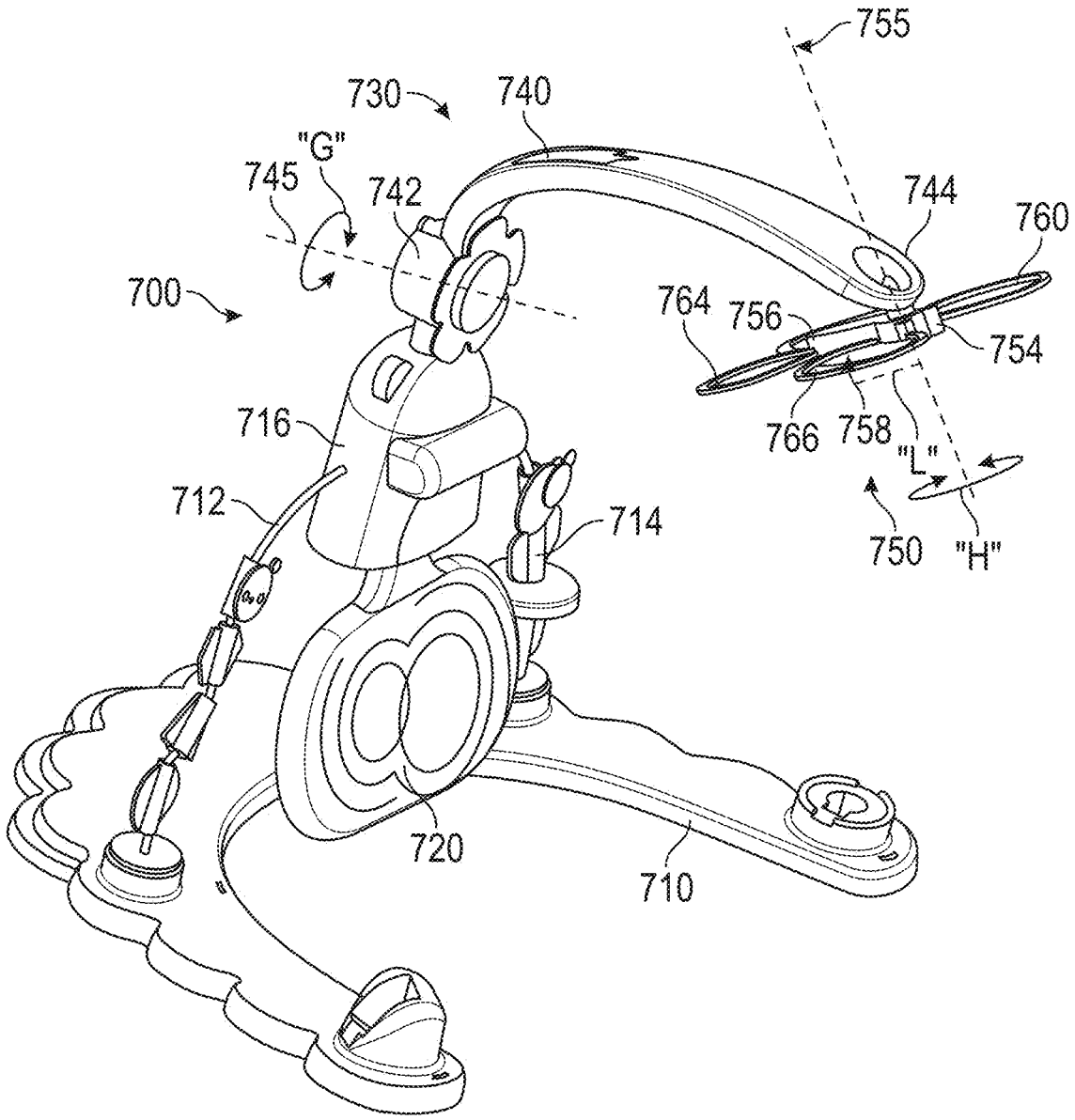
FIG. 14 is a perspective view of another embodiment of an infant entertainment device according to the present invention.
Figure 15:
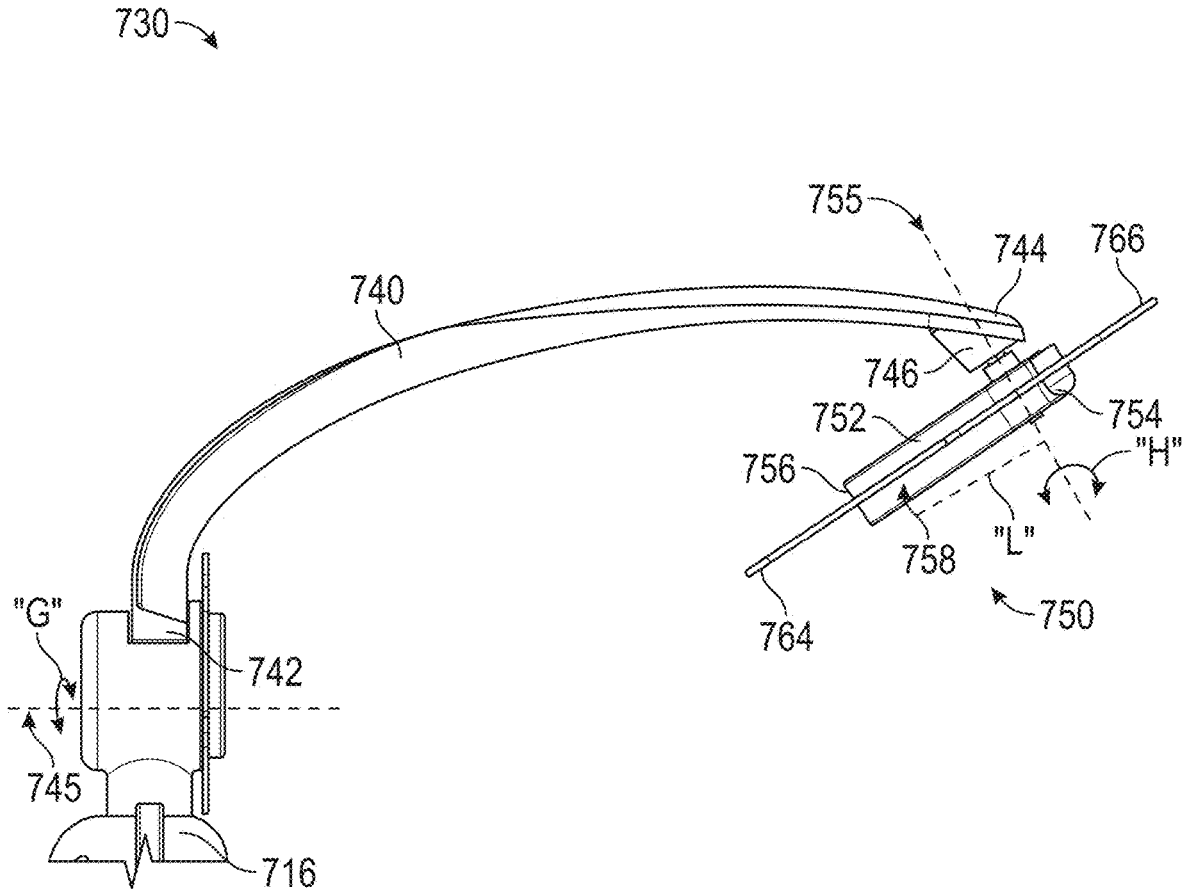
FIG. 15 is a side view of a portion of the infant entertainment device illustrated in FIG. 14.
Figure 16:
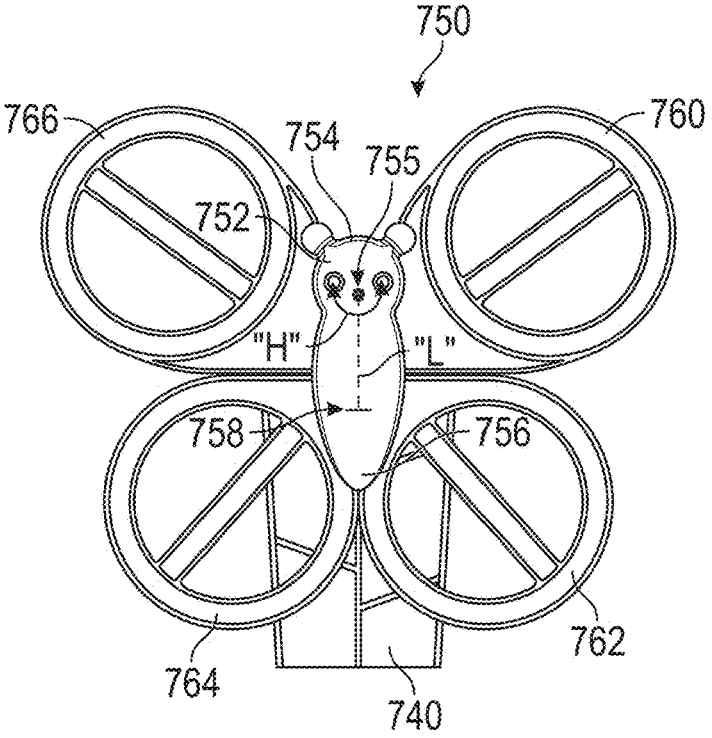
FIG. 16 is a front view of an entertainment portion of the infant entertainment device illustrated in FIG. 14.

Referring to FIGS. 14-19, an alternative embodiment of an infant entertainment device according to the present disclosure is illustrated. Referring to FIGS. 14-16, a perspective view of infant entertainment device 700 is shown. Infant entertainment device 700 includes a base 710 from which two supports or support wires 712 and 714 extend to support a housing 716 therebetween. Movably coupled to the housing 716 is an engagement portion 720 that is positioned so that it can be engaged by an infant located proximate to the infant entertainment device 700. When an infant engages the engagement portion 720, such as by kicking engagement portion 720 with the infant's feet, the engagement portion 720 causes a drive mechanism of the infant entertainment device 700 to move an entertainment portion 730 relative to the housing 716.

In this embodiment, the entertainment portion 730 includes a pivotally mounted arm 740 that reciprocates relative to the housing 716. As shown in FIG. 14, arm 740 has a driven end 742 and a free or distal end 744 that is opposite to the driven end 742. Arm 740 is coupled to the housing 716, and, in this embodiment, its driven end 742 is disposed in the housing 716. The driven end 742 moves in a reciprocating or back and forth manner about pivot axis 745 along the directions of arrows "G". As driven end 742 moves back and forth about pivot axis 745, the free end 744 of arm 740 swings back and forth about pivot axis 745 as well. In view of free end 744 being spaced apart from and at the opposite end of arm 740 from the driven end 742, the distance that the free end 744 moves is much greater than the distance that the driven end 742 rotates.

As shown in FIGS. 14-16, coupled to free end 744 of the pivotally mounted arm 740 is a moving component 750 which includes several display portions 760, 762, 764, and 766 are coupled. In this embodiment, the free end 744 includes a housing 746 that defines a through hole that pivotally receives a mounting post extending from the moving component 750 to pivotally couple the moving component 750 to the arm 740. The display portions 760, 762, 764, and 766 are disposed so that they extend outwardly from the moving component 750 away from and relative to each other. Since the moving component 750 is coupled to the distal end 744 of the arm 740, as the arm 740 swings back and forth, the moving component 750 will rotate relative to the arm 740, thereby moving or spinning the display portions 760, 762, 764, and 766 relative to the arm 740 and to the moving component 750.

Referring to FIG. 16, the moving component 750 includes a body 752 that has an upper portion 754 and a lower portion 756. The body 752 is rotatably mounted to the distal end 744 of arm 740 and freely pivots about pivot axis 755 along the directions of arrows "H". In various embodiments, the weight of the body 752, or the center of gravity of the body 752, is offset from the pivot axis 755. In this embodiment, the center of gravity is designated by 758, which is shown in FIG. 16 by a distance "L" from the pivot axis 755.

Referring back to FIGS. 14 and 15, as the driven end 742 of arm 740 is moved back and forth about pivot axis 745 along the directions of arrow "G", the distal end 744 of the arm 740 rotates back and forth as well. The pivot connection between the distal end 744 and the moving component 750 allows the body 752 to rotate or swing back and forth about pivot axis 755 along the directions of arrow "H". As mentioned above, the distal end 744 of arm 740 moves a greater distance back and forth than the driven end 742 of arm 740 moves. The movement of the distal end 744 causes the body 752 to swing back and forth. Since the weight of the body 752 is offset from the pivot axis 755, and depending its location, movement of the body 752 back and forth can sometimes result in the body 752 whipping around pivot axis 755 and making one or more full rotations about the pivot axis 755. The movement of body 752 can be inconsistent and random based on the distance "L" that the weight or center of gravity of the body 752 is offset from pivot axis 755.

The weight of the toy or the center of gravity 758 can be offset from the pivot axis 755 due to the shape and configuration of the body 752, namely, the pivot axis 755 being located closer to the upper end of the body 752 than to the lower end of the body 752. By varying the location of the center of gravity 758 of body 752, and in particular, the distance "L", the movement of the body 752 can be adjusted. In alternative embodiments, a weight can be coupled to the body 752 at different locations, thereby changing the center of gravity 758 and the pattern of movement of the body 752. Alternatively, a weight can be slidably mounted to the body 752 so its position relative to the pivot axis 755 is adjustable.

Figure 17:
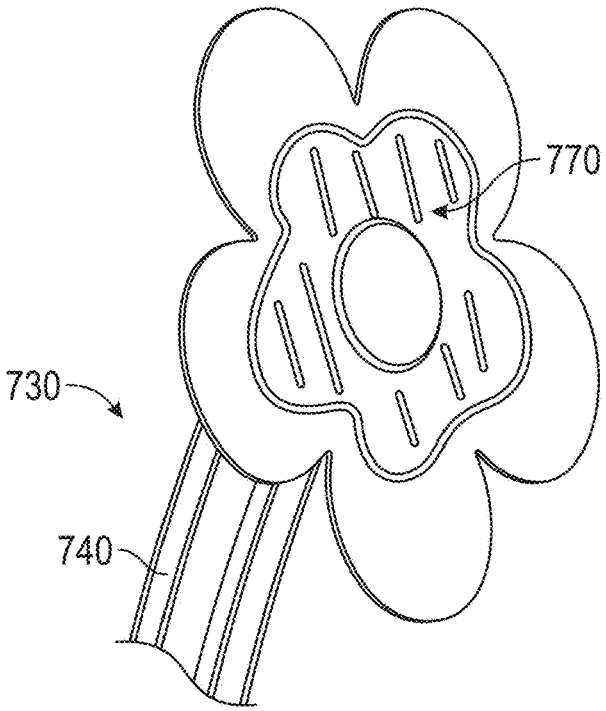
FIG. 17 is a perspective view of some softgoods components of the infant entertainment device illustrated in FIG. 14.

Turning to FIG. 17, a perspective view of an embodiment of the entertainment portion 730 is illustrated. As shown, a softgoods covering 770 is coupled to the display portions 760, 762, 764, and 766 (not shown in FIG. 17) which provide support for the softgoods covering 770.

Figure 18:
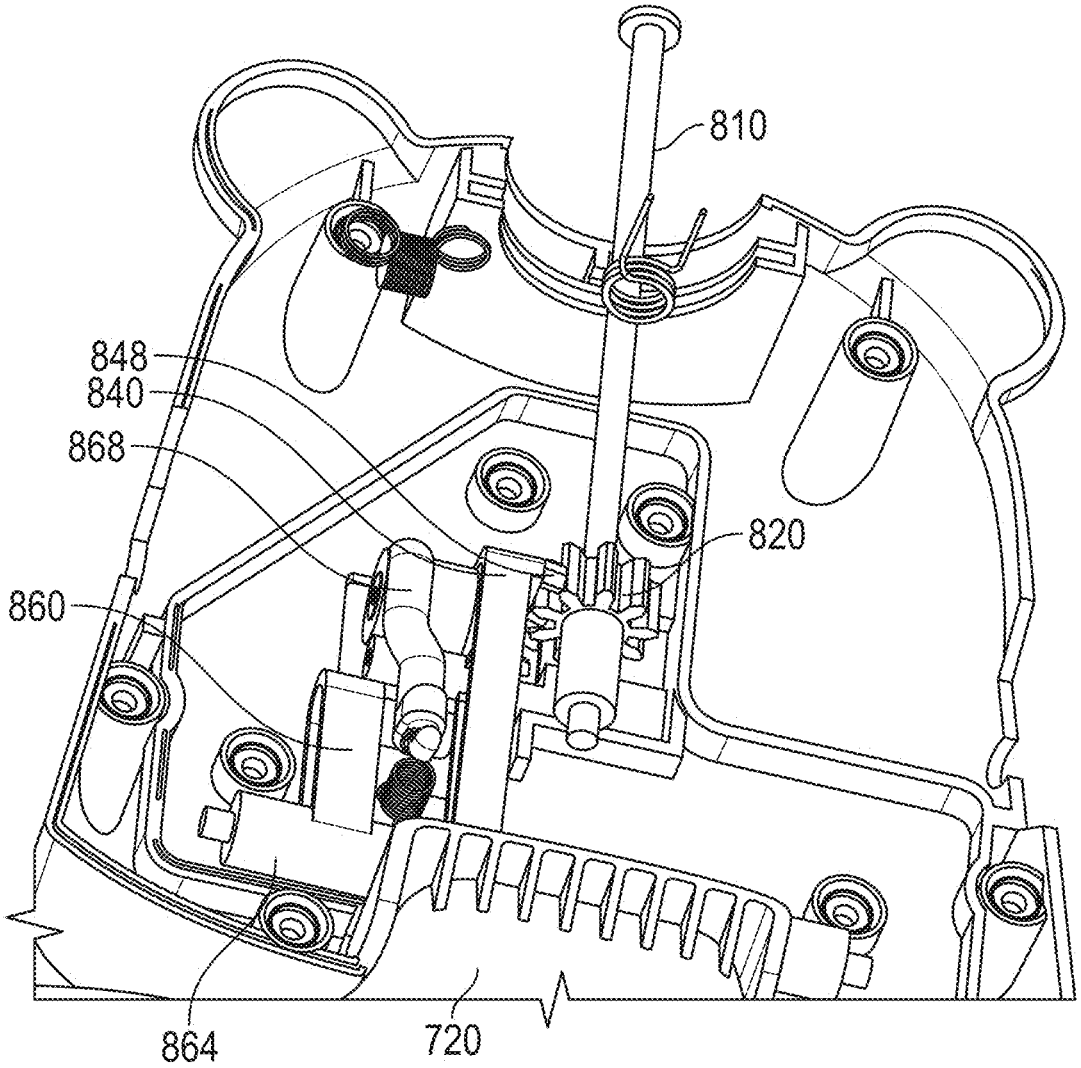
FIG. 18 is an internal view of some components of the infant entertainment device illustrated in FIG. 14.
Figure 19:
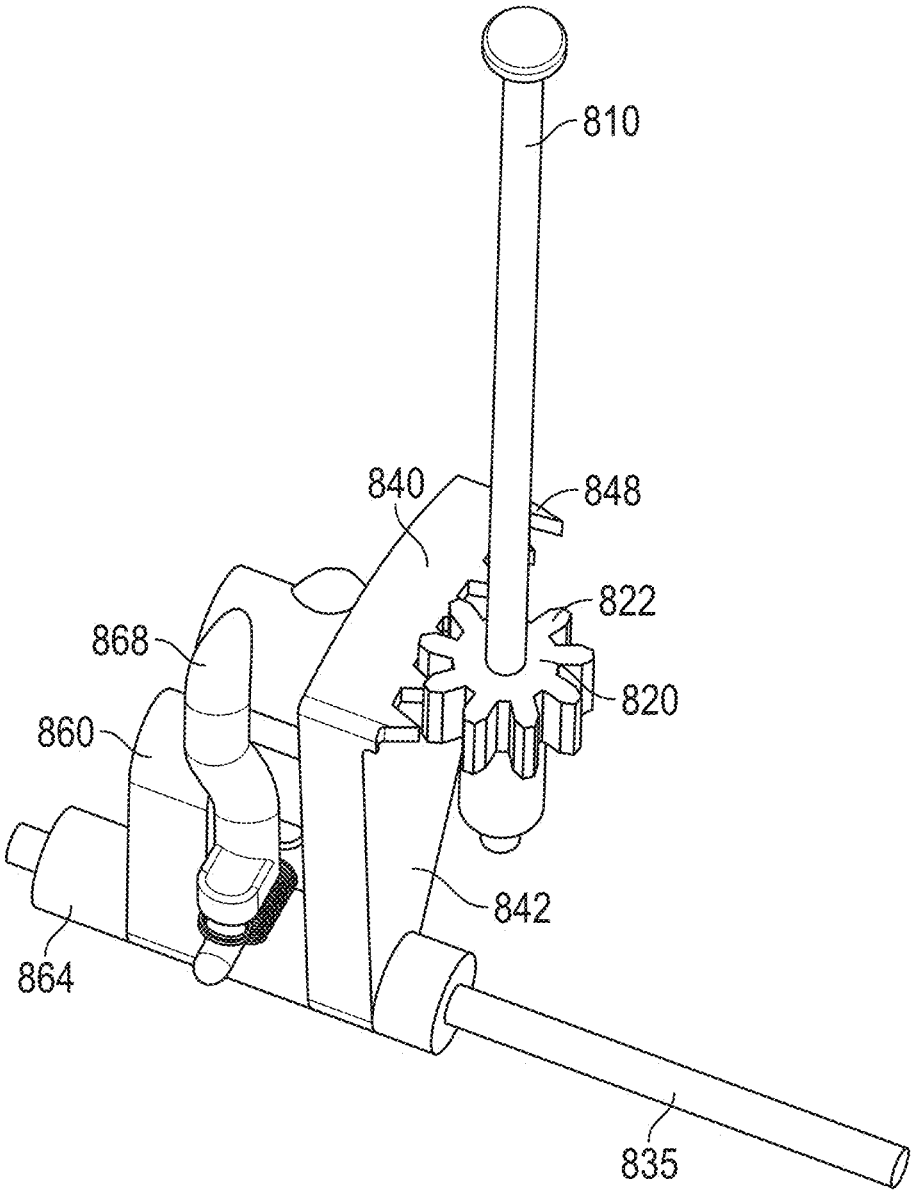
FIG. 19 is a top perspective view of some components of a drive mechanism of the infant entertainment device illustrated in FIG. 14.

Turning to FIGS. 18 and 19, some of the components of the drive mechanism of the infant entertainment device 700 are illustrated. The drive mechanism includes an axle 810 that is coupled to the arm 740. Rotation of axle 810 causes the arm 740 to rotate. Mounted on the axle 810 for rotation therewith is a gear 820 that has teeth 822 around its periphery. The drive mechanism includes a gear 840 that has a body 842 with teeth 848 arranged along an arcuate portion of the body 842. As shown in FIG. 19, gear 840 is mounted to axle 835 can rotate about axle 835. The drive mechanism includes a clutch 860 with a mounting portion 864 and a drive portion 868. When an infant pushes on the engagement portion 720, the mounting portion 864 rotates with axle 835. As a result, rotation of mounting portion 864 causes movement of the drive portion 868, which in turn moves gear 840 via a biasing mechanism that engages both the drive portion 868 and the gear 840.

In the foregoing detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the foregoing detailed description is not to be taken in a limiting sense, and the scope of embodiments is defined by the appended claims and their equivalents.

Aspects of the disclosure are disclosed in the description herein. Alternate embodiments of the present disclosure and their equivalents may be devised without parting from the spirit or scope of the present disclosure. It should be noted that any discussion herein regarding "one embodiment", "an embodiment", "an exemplary embodiment", or a similar phrase indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

While the apparatuses and methods presented herein have been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. For example, the infant positioner or infant support structures/apparatuses presented herein may be modified to contain any number of upstanding frame members, seat supports, interactive assemblies, interactive components, interactive elements, etc. Moreover, the infant positioner or infant support structures/apparatuses presented herein may be modified to resemble any other structure, device, etc.

In addition, various features from one of the embodiments may be incorporated into another of the embodiments. That is, it is believed that the disclosure set forth above may encompass multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Accordingly, it is appropriate that the appended claims be construed broadly and in a manner consistent with the scope of the disclosure as set forth in the following claims.

It is also to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention. Additionally, it is also to be understood that the infant positioner or infant support structures/apparatuses described herein, and any portions thereof, may be fabricated from any suitable material or combination of materials, such as plastic, metals, composites, etc., as well as derivatives thereof, and combinations thereof.

The terms "comprising," "including," "having," and the like, as used with respect to embodiments of the present disclosure, are synonymous. When used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about", "around", "generally", and "substantially."

What is claimed is:

1. An infant entertainment device, comprising:

a support member for an infant;

a housing positioned above the support member;

an entertainment component rotatably coupled to the housing, the entertainment component being movable relative to the housing between a first position and second position, the entertainment component including an arm and a moving component coupled to the arm at a pivot axis, the moving component being rotatable about the pivot axis as the arm moves back and forth, the moving component including a body with a center of gravity that is offset from the pivot axis, and movement of the body about the pivot axis is randomized by the center of gravity being offset from the pivot axis;

an input mechanism movably supported by the housing, the input mechanism being pivotally mounted and movable between a third position and a fourth position, the input mechanism being located above the support member so the input mechanism can be kicked by an infant lying on the support member; and a drive mechanism connected to the entertainment component and to the input mechanism, wherein movement of the input mechanism from its third position to its fourth position causes the drive mechanism to move the entertainment component from its first position to its second position.

2. The infant entertainment device of claim 1, wherein the drive mechanism includes a biasing member that engages the input mechanism, and the biasing member applies a force to the input mechanism so that the input mechanism moves from its fourth position to its third position.

3. The infant entertainment device of claim 2, wherein the biasing member is a first biasing member, the drive mechanism includes a second biasing member, and each of the first biasing member and the second biasing member engaging the input mechanism.

4. The infant entertainment device of claim 3, wherein the housing includes an axle, the input mechanism is rotatably mounted on the axle, the input mechanism includes an engagement portion and a pair of mounting portions coupled to the engagement portion, each of the first biasing member and the second biasing member contacting one of the mounting portions, and each of the mounting portions being rotatably mounted on the axle.

5. The infant entertainment device of claim 1, wherein the drive mechanism includes:

a first axle having a first gear mounted thereon, the first axle being connected to the entertainment component so that movement of the first gear results in rotation of the first axle and rotation of the entertainment component; and a second axle having a second gear mounted thereon, the second gear being engaged with the first gear so that rotation of the second gear drives the first gear.

6. The infant entertainment device of claim 5, wherein the drive mechanism includes:

a third axle having a clutch member rotatably mounted thereon, the clutch member being engaged with the second gear, the input mechanism is rotatably mounted on the third axle, and movement of the input mechanism drives the clutch member to rotate about the third axle which causes the second gear to rotate.

7. The infant entertainment device of claim 6, wherein the input mechanism includes a first keying member, the clutch member includes a second keying member, the second keying member being engaged with the first keying member so that movement of the input mechanism causes the clutch member to move.

8. The infant entertainment device of claim 7, wherein the second gear includes a body having a first side and a second side opposite the first side, the body includes an arcuate toothed portion on the first side and a tab extending from the second side, the tab being engaged by the clutch member, and movement of the clutch member drives the tab of the body, thereby causing the second gear to rotate.

9. The infant entertainment device of claim 8, wherein the clutch member includes:

a clutch body having:

a mounting portion including the second keying member, the mounting portion being mounted on the third axle, and a drive portion coupled to the mounting portion; and a biasing mechanism, wherein the biasing mechanism is moved by the drive portion of the clutch body, the biasing mechanism engages the tab of the second gear, and movement of the biasing mechanism drives the tab and rotates the second gear.

10. An infant entertainment device, comprising:

a support member for an infant;

a housing positioned above the support member;

an entertainment component coupled to the housing and movable relative to the housing between a first position and second position, the entertainment component including an arm and a moving component coupled to the arm at a pivot axis, the moving component being rotatable about the pivot axis as the arm moves back and forth, the moving component including a body with a center of gravity that is offset from the pivot axis, and the movement of the body about the pivot axis is randomized by the center of gravity being offset from the pivot axis;

an input mechanism coupled to the housing and movable between a third position and a fourth position, the input mechanism being located above the support member so the input mechanism can be kicked by an infant lying on the support member; and a drive mechanism connected to the entertainment component and to the input mechanism, the drive mechanism includes a biasing member, wherein movement of the input mechanism from its third position to its fourth position causes the entertainment component to move from its first position to its second position, and the biasing member biases the input mechanism from its fourth position to its third position, thereby causing the entertainment component to return from its second position to its first position.

11. The infant entertainment device of claim 10, wherein the input mechanism is pivotally mounted to the housing and is located below the housing.

12. The infant entertainment device of claim 11, wherein the entertainment component is rotatably mounted to the housing and is located above the housing.

13. The infant entertainment device of claim 10, wherein the biasing member is a first biasing member, the drive mechanism includes a second biasing member, and each of the first biasing member and the second biasing member engages the input mechanism to bias the input mechanism from its fourth position to its third position relative to the housing.

14. The infant entertainment device of claim 10, wherein the drive mechanism includes:

a first axle having a first gear mounted thereon, the first axle being connected to the entertainment component so that movement of the first gear results in rotation of the first axle and rotation of the entertainment component;

a second axle having a second gear mounted thereon, the second gear being engaged with the first gear so that rotation of the second gear drives the first gear; and a third axle having a clutch member rotatably mounted thereon, and the clutch member is engaged with the second gear.

15. The infant entertainment device of claim 14, wherein the input mechanism is rotatably mounted on the third axle, movement of the input mechanism drives the clutch member to rotate about the third axle which causes the second gear to rotate, the input mechanism includes a first keying member, the clutch member includes a second keying member, and the second keying member being engaged with the first keying member so that movement of the input mechanism causes the clutch member to move.

16. An infant entertainment device, comprising:

a support member for an infant;

a housing positioned above the support member;

an entertainment component coupled to the housing and movable relative to the housing about a first axis between a first position and second position, the entertainment component including an arm and a moving component coupled to the arm at a pivot axis, the moving component being rotatable about the pivot axis as the arm moves back and forth, the moving component including a body with a center of gravity that is offset from the pivot axis, and the movement of the body about the pivot axis is randomized by the center of gravity being offset from the pivot axis;

an input mechanism coupled to the housing and movable about a second axis between a third position and a fourth position, the input mechanism being located above the support member so the input mechanism can be kicked by an infant lying on the support member; and a drive mechanism connected to the entertainment component and to the input mechanism, the drive mechanism includes a biasing member, wherein movement of the input mechanism about the second axis from its third position to its fourth position causes the entertainment component to move about the first axis from its first position to its second position, and the biasing member biases the input mechanism from its fourth position to its third position, thereby causing the entertainment component to return from its second position to its first position, the second axis being perpendicular to the first axis.

17. The infant entertainment device of claim 16, wherein the input mechanism is pivotally mounted to the housing and is located below the housing, and the entertainment component is rotatably mounted to the housing and is located above the housing.

* * * * *